United States Patent [19]

Novitskey

[11] Patent Number: 4,474,194

[45] Date of Patent: Oct. 2, 1984

[54] HAIR NET STRIP

[76] Inventor: Julia A. Novitskey, 15777 Bolesta Rd. N. 247, Clearwater, Fla. 33520

[21] Appl. No.: 429,800

[22] Filed: Sep. 30, 1982

[51] Int. Cl.[3] ..... A45D 2/00

[52] U.S. Cl. ..... 132/38; 2/195; 132/9

[58] Field of Search ..... 132/38, 9, 49, 53; 2/195, 197, 63, 207, 337, 410, 171

[56] References Cited

U.S. PATENT DOCUMENTS

| | | | |
|---|---|---|---|
| 1,872,642 | 8/1932 | Welsh | 132/9 UX |
| 1,999,252 | 4/1935 | Mullendore | 132/9 X |
| 2,030,135 | 2/1936 | Carpenter | 2/337 |
| 2,255,708 | 9/1941 | Laughton | 132/9 X |
| 2,629,869 | 3/1953 | Locken | 2/197 X |
| 2,860,081 | 11/1958 | Eiken | 2/337 |
| 3,088,469 | 5/1963 | Berryhill et al. | 132/9 |
| 3,197,787 | 8/1965 | Tognan et al. | 132/49 X |
| 3,392,737 | 7/1968 | Fefferman | 132/49 |
| 3,556,115 | 1/1971 | Benson | 132/49 |
| 4,176,669 | 12/1979 | Levin | 132/53 |

*Primary Examiner*—Gregory E. McNeill
*Attorney, Agent, or Firm*—Samuel R. Genca

[57] ABSTRACT

A hair net strip for protecting a coiffure is disclosed wherein a longitudinal strip of netting material having a length and width sufficient to cover the coiffure and a person's head along the forehead, nape and sides thereof and a pressure sensitive adhesive which is non-irritating to the skin is fixed to the strip and adapted to contact said person's forehead, nape and sides to adhere thereto and to maintain said hair net strip in a coiffure protective position about the person's head.

4 Claims, 11 Drawing Figures

HAIR NET STRIP

Background of the Invention

1. Field of the Invention

The present invention relates generally to hair nets and more particularly to a new and improved hair net to protect a coiffure or elaborate hairdo or arrangement while the person is active or asleep.

Women of today have steadily become more active than heretofore in their careers and in the business world and socially. Such activity requires a great deal of their time thereby leaving less time for them to personally maintain their coiffures. Since time must be devoted to their business or careers, there is a pressing need for women to maintain their coiffures for longer periods of time between visits to a beauty salon without additional cost or time. While the frequency of visits to a beauty salon may not be changed, the coiffure may be more easily maintained between visits with the hair net strip in accordance with the present invention.

2. Prior Art

In the past, conventional hair nets were used. Such hair nets generally comprise a simple net surrounded by an elastic band which kept the hairdo or coiffure in place. The problem with such hair nets is that the elastic band is uncomfortable and has a tendency to roll up and be displaced on a person's head and at times when it is being removed from a person's head, it may disturb the coiffure.

SUMMARY OF THE INVENTION

Briefly described, a hair net strip in accordance with the preferred embodiment of the invention for protecting a coiffure includes a longitudinal strip of netting material having a length and width sufficient to cover the coiffure and person's head along the forehead, nape and sides thereof. The strip is also of sufficient length to overlap at the ends thereof and an adhesive coating that is relatively non-irritating to the skin is fixed to the edge of the strip for adhering the hair net strip to the hair or skin along the forehead, nape and sides of a person's head so that the hair net strip protects the coiffure when placed about the coiffure and head. The adhesive firmly adheres the net to the head so that the person may be awake and active or asleep in bed without worry of the net rolling up or disturbing the coirffure and yet be easily removed without disturbing the coiffure.

BRIEF DESCRIPTION OF THE DRAWINGS

The invention will be better understood upon consideration of the following detailed description taken together with the accompanying drawings in which are like elements in various figures having like designations and in which.

DESCRIPTION OF THE PREFERRED EMBODIMENT

Figure 1:
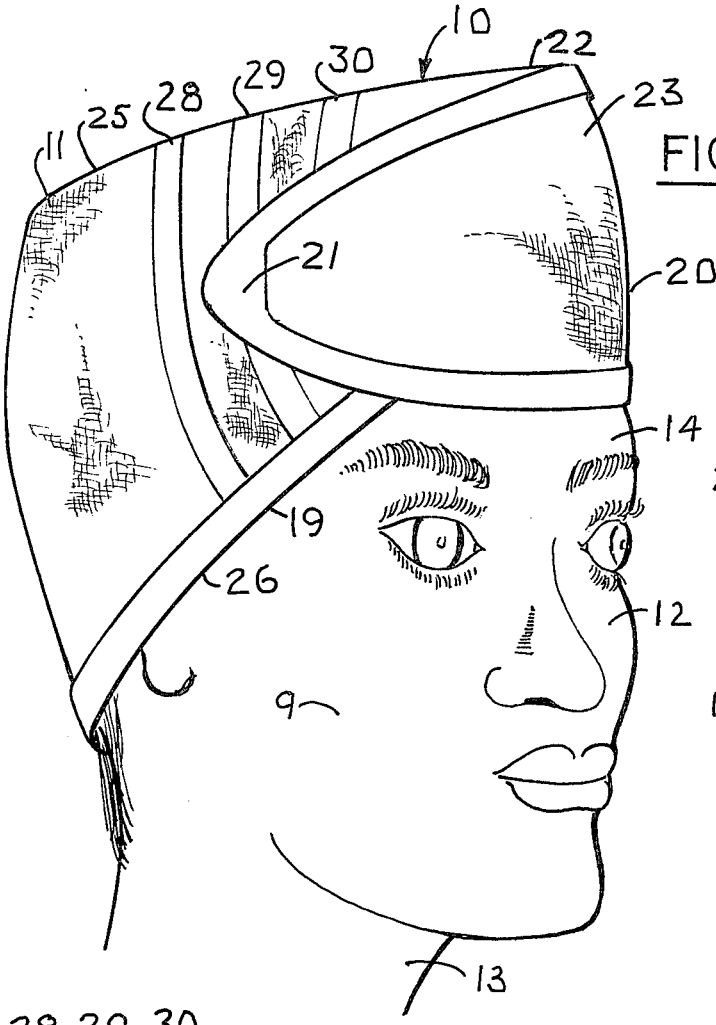
FIG. 1 is a perspective view of a person wearing a hair net strip in accordance with a preferred embodiment of the invention.

The hair net strip of the present invention will be described with particular reference to the preferred embodiment illustrated in the drawing. It should be understood that the drawing illustrations and description are to be taken only as illustrative of the preferred embodiment of the hair net strip of the present invention and is to be understood in a general way and not in a restrictive way.

FIGS. 1–6 show a hair net strip 10 in accordance with a preferred embodiment of the invention for protecting a hairdo or coiffure 11 on the head 12 of a person 13.

The hair net strip 10 when in use is placed about the head 12 across the forehead 14, the nape 15 and the right and left sides 16 and 17. The forehead 14, the nape 15, right side 16 and left side 17 lie along a circumference 19 about the head 13.

Figure 2:
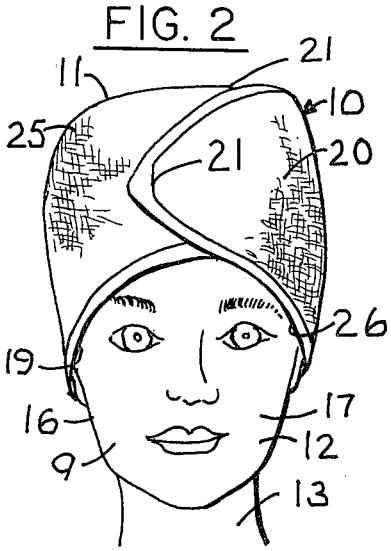
FIG. 2 is a front view of the hair net strip illustrated in FIG. 1 being worn by the person.
Figure 3:
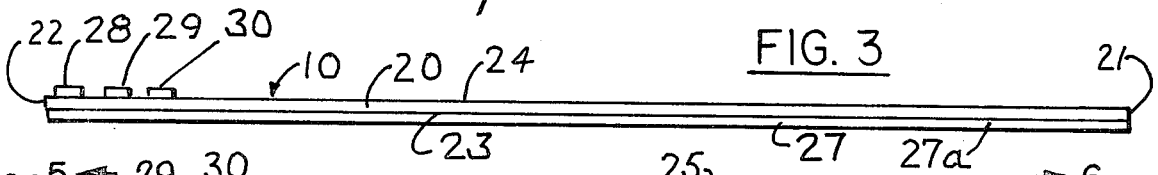
FIG. 3 is a side view of the hair net strip in accordance with a preferred embodiment of the invention.
Figure 4:
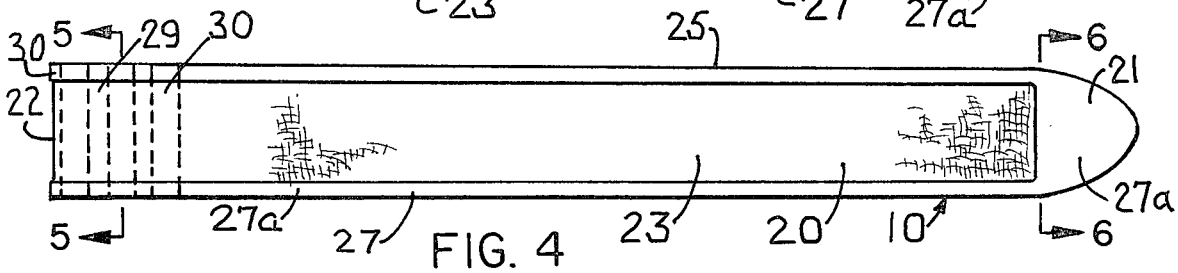
FIG. 4 is a front view of the hair net strip in accordance with a preferred embodiment of the invention.
Figure 5:
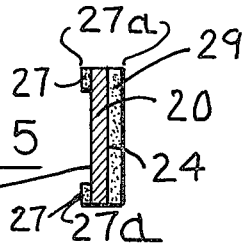
FIG. 5 is a cross-sectional view of the hair net strip taken along lines 5—5 of FIG. 4.
Figure 6:
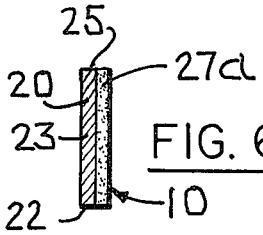
FIG. 6 is a cross-sectional view of the hair net strip taken along lines 6–6 of FIG. 4.

The hair net strip 10 comprises a longitudinal strip 20 of a net material which is preferably a resilient, thin, porous tissue-like fabric. The longitudinal strip 20 has a relatively high tensile strength in both the dry and wet conditions. The longitudinal strip 20 is preferably made of inexpensive material so that the hair net strip 10 may be disposed of after the hair net strip 10 has been used. The longitudinal strip 20 in the flat position as shown in FIGS. 3 and 4 has a length which is greater than the circumference 19 and is of sufficient length so that left end 21 overlaps right end 22 of the longitudinal strip 20 when the hair net strip 10 is in use as illustrated in FIGS. 1 and 2. The longitudinal strip 20 is rectangular at end 22 while end 21 is triangular in shape to permit easy overlapping of the ends 21 and 22. In other words, alignment is not critical as long as the coiffure and head 12 are covered by the longitudinal strip 20. For that purpose, the width of the longitudinal strip 20 should be of a magnitude to cover the coiffure. Thus, the width of the longitudinal strip 20 is a function of the height of the coiffure and may come in various sizes to accommodate the coiffure. The longitudinal strip 20 has a hair and skin contacting inner surface 23 and an outer surface 24. The outer surface 24 of the longitudinal strip 20 may be smooth so that when the person 13 sleeps, the head 12 may easily move on a pillow or sheet (not shown).

The longitudinal strip 20 includes an upper edge 25 and a lower edge 26. The longitudinal strip 20 may be compacted along the upper and lower edges 25, 26 and end 21 so that the web material between the edges 25, 26 may be thinner than the upper and lower edges 25, 26. The upper and lower edges 25, 26 and end 21 are coated on the inner surface 24 with a thin, smooth visibly continuous hydrophobic transparent skin adhering pressure sensitive adhesive **27*a* to form a tape 27, similar to a tape described in U.S. Pat. No. 3,121,021. The adhesive coated tape 27 in the preferred embodiment essentially consists of a water-insoluble hydrophobic viscoelastic adhesive polymer which is also highly cohesive and pressure sensitive without being irritating to the human skin 9 and can be removed from the skin 9 after prolonged adhering contact. The tape 27 is sufficiently porous to permit perspiration and other liquids to evaporate through the tape 27 when it is adhered to the human skin 9. If desired, the tape 27 may be a separate tape not formed by the compacted edges 25, 26**.

The longitudinal strip 20 also includes vertical tapes 28, 29, 30 similar to tape 27 on the outer surface 23 proximal to end 22. The vertical tapes 28, 29, 30 coact with end 21 for holding the longitudinal strip 20 in a cylindrical shape about the head 12 of the person 13. The vertical tapes 28, 29, 30 are spaced apart to accommodate various sizes of heads 12. The vertical tapes 28, 29, 30 and the triangular shaped end 21 of the strip 20 overlap in a "quick-to-find" adhering state. In effect, the vertical tapes 28, 29, 30 and triangular end 21 crisscross each other to secure the hair net strip 10 as shown in FIGS. 1 and 2.

OPERATION

In the operation and use of the hair net strip 10, the hair net strip 10 is held at each end 21 and 22 in a straight stretched condition in back of the head 12. The lower edge 26 of the hair net strip 10 is then placed tightly in contact with the nape 15 of the head 12 and the hair net strip 10 is then wrapped about the right and left sides 16, 17 and across the forehead 14 in an overlapping state so that the ends 21, 22 are in adhering contact by tape 27 at end 21 and vertical tapes 28, 29, 30 at end 22 of the hair net strip 10. The tape 27 at the lower edge 26 should touch the skin 9 wherever possible especially the head 12 near the right and left ears 7, 8 and across the forehead 14. The upper edge 25 and tape 27 may, if desired, be patted down to fit the coiffure 11 or the hair net strip 10 may be left in a cylindrical shape about the head 12.

To remove the hair net strip 10, the ends 21, 22 of the hair net strip 10 are pulled apart without disturbing the coiffure 11 and the hair net strip 10 is removed from the head 12.

EMBODIMENTS OF THE INVENTION

Figure 7:
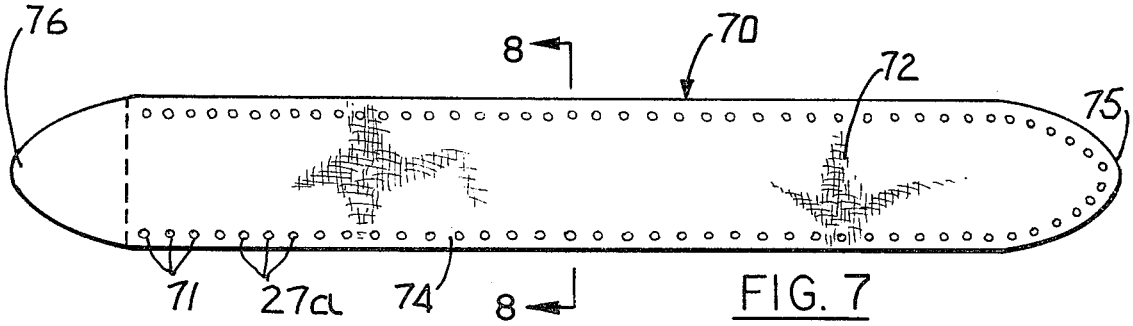
FIG. 7 is a front view of another embodiment of another hair net strip showing another feature of the invention.
Figure 8:
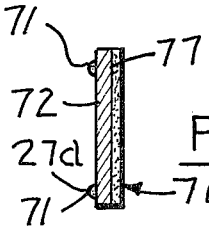
FIG. 8 is a cross-sectional view of the hair net strip of FIG. 7 taken along lines 8—8.

Referring now to FIGS. 7 and 8, another embodiment of the invention is shown in a hair net strip 70 similar to the hair net strip 10, except that instead of a continuous adhesive **27*a* along tape 27 (FIG. 4), spots 71 of adhesive 27*a* are fixed to the inner surface 72 of a longitudinal strip 73 along a path 74 around the perimeter 78 of the longitudinal strip 73. This of course serves two purposes, first, there is a savings of adhesive 27*a* and secondly, there is spot contacting instead of continuous contacting between the adhesive 27*a* and the skin 9 of the head 12. A further difference between the hair net strip 10 and hair net strip 70 is that both ends 75, 76** are triangular in shape.

The longitudinal strip 73 has an outer surface 77 upon which adhesive **27*a* is coated at end 76. The longitudinal strip 73 may be made of various webbing material similar to the longitudinal strip 20 of FIG. 1**.

Figure 9:
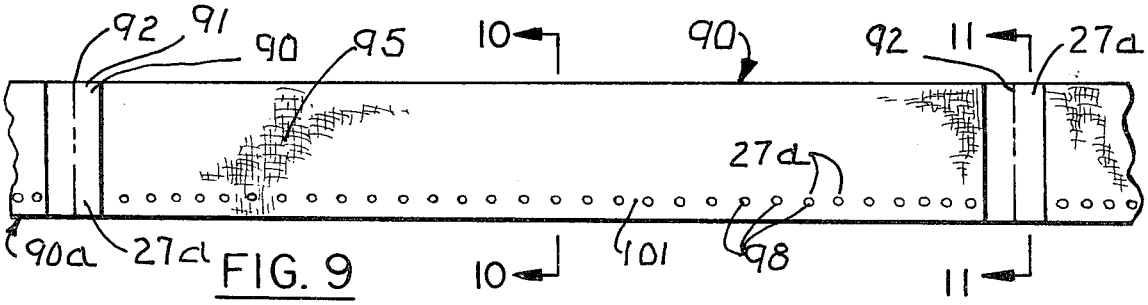
FIG. 9 is another embodiment of the invention in a hair net strip which is produced in series and separable by cutting or tearing along a perforated web section.
Figure 10:
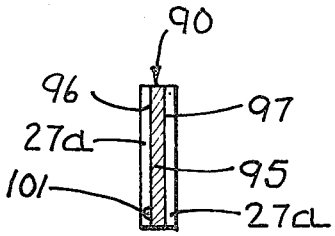
FIG. 10 is a cross-sectional view of the hair net strip of FIG. 9 taken along lines 10—10.
Figure 11:
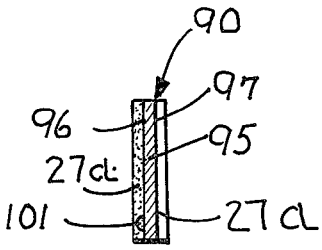
FIG. 11 is a cross-sectional view of a hair net strip of FIG. 7 taken along lines 11—11.

Referring now to FIGS. 9–11, another embodiment of the invention is shown in a hair net strip 90 similar to the hair net strip 10 of FIG. 1.

The hair net strip 90 may be made in continuous hair net strips **90, 90*a*, 90*b* which may be sold in a roll form (not shown) if desired. Each of the hair net strips 90, 90*a*, 90*b* may be separated at a preferred web portion 91 at lines 92. The hair net strip 90 differs from the hair net strip 10 in that the ends 93, 94 are rectangular in shape for easy tearing or cutting of the longitudinal strip 95 of the netting material so as to separate the hair net strips 90, 90*a*, 90*b***.

The longitudinal strip 95 also has inner and outer surfaces 96, 97. The ends 93 and 94 of the longitudinal strip 95 are coated with adhesive **27*a* on both the inner surface 96 and outer surface 97 at ends 93 and 94. The hair net strip 90 includes a single row 101 of spots 98 of adhesive 27*a* on inner surface 96 of longitudinal strip 95. The spots 98 of adhesive 27*a* are employed for the same reason given for the hair net strip 70 except that a single row 101 is employed for a further savings of adhesive 27*a***.

Modifications and alterations may occur to those skilled in the art, for example, the tape 27 of FIG. 1 may be a two-sided tape, one side of which adheres to the longitudinal strip 20 and the other side adheres to the human skin 9.

Having thus described the invention, it will be evident that other modifications and improvements may be made by one skilled in the art which would come within the scope of the annexed claims.

What is claimed as new and desired to be secured by Letters Patent of the United States is:

1. A hair net strip for protecting a coiffure, said hair net strip comprising:

(a) a longitudinal strip of netting material having a length and width to cover both said coiffure and a person's head along the forehead, nape and sides thereof, (i) said longitudinal strip being of a length to overlap at the ends thereof so that said hair net strip may be wrapped about both said coiffure and said person's head along said forehead, said nape and said sides, (ii) said netting material having a relatively high tensile strength in both dry and wet conditions, (iii) said longitudinal strip having an inner surface for contacting both said coiffure and said person's head along said forehead, said nape and said sides thereof, and (b) adhesive means for adhering said netting material to said person's head along said forehead, said nape and said sides thereof in both said wet and said drya conditions, (i) said adhesive means includes a water insoluble hydrophobic viscoelastic adhesive polymer coated along a given path to said inner surface of said longitudinal strip in cooperative relationship with said longitudinal strip for adhering said netting material to said person's head along said forehead, said nape and said sides along said given path and coated on said overlapping ends of said longitudinal strip for adhering together said overlapping ends of said longitudinal strip.

2. The invention defined in claim 1 further including a plurlity of said hair net strips in series connected by a web separable as by tearing or cutting.

3. The invention defined in claim 1 wherein said longitudinal strip has an upper longitudinal edge and lower longitudinal edge, each of which has a thickness greater than the area lying between said upper and lower longitudinal edges of said longitudinal strip.

4. A hair net strip for protecting a coiffure, said hair net strip comprising:

(a) a longitudinal strip of netting material having a length and width to cover both said coiffure and a person's head along the forehead, nape and sides thereof, (i) said longitudinal strip being of a length to overlap at the ends thereof so that said hair net strip may be wrapped about both said coiffure and said person's head along said forehead, said nape and said sides, (ii) said netting material having a relatively high tensile strength in both dry and wet conditions, (iii) said longitudinal strip having an inner surface for contacting both said coiffure and said person's head along said forehead, said nape and said sides thereof, and (b) adhesive means for adhering said netting material to said person's head along said forehead, said nape and said sides thereof in both said wet and said dry conditions, (i) said ahdesive means includes first and second tapes, each having water insoluble hydrophobic viscoelastic adhesive polymer coating, (ii) said first tape being fixed along a given path to said inner surface of said longitudinal strip in cooperative relationship with said longitudinal strip for covering said coiffure while adhering said netting material to said person's head along said forehead, said nape and said sides along said given path, and (iii) said second tape being fixed at said overlapping ends of said longitudinal strip for adhering togther said overlapping ends of said longitudinal strip.

* * * * *